US011407959B2

(12) United States Patent
Hong et al.

(10) Patent No.: US 11,407,959 B2
(45) Date of Patent: Aug. 9, 2022

(54) DRIVELINE FLUIDS COMPRISING API GROUP II BASE OIL

(71) Applicants: Chevron U.S.A. Inc., San Ramon, CA (US); The Lubrizol Corporation, Wickliffe, OH (US)

(72) Inventors: Hyun-Soo Hong, San Ramon, CA (US); John Aleksonis Zakarian, San Ramon, CA (US); Sona Sivakova, Wickliffe, OH (US); Tomoya Higuchi, Wickliffe, OH (US); Christopher Engel, Wickliffe, OH (US); Farrukh Qureshi, Wickliffe, OH (US)

(73) Assignees: The Lubrizol Corporation, Wickliffe, OH (US); Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 16/320,985

(22) PCT Filed: Jul. 28, 2016

(86) PCT No.: PCT/US2016/044579
§ 371 (c)(1),
(2) Date: Jan. 25, 2019

(87) PCT Pub. No.: WO2018/022071
PCT Pub. Date: Feb. 1, 2018

(65) Prior Publication Data

US 2019/0177649 A1 Jun. 13, 2019

(51) Int. Cl.
*C10M 169/04* (2006.01)
*C10M 101/00* (2006.01)
(Continued)

(52) U.S. Cl.
CPC ..... *C10M 169/041* (2013.01); *C10M 101/00* (2013.01); *C10M 143/04* (2013.01);
(Continued)

(58) Field of Classification Search
CPC ..... C10M 2203/003; C10M 2205/024; C10N 2240/04; C10N 2230/08; C10N 2230/10;
(Continued)

(56) References Cited

U.S. PATENT DOCUMENTS 4,704,491 A * 11/1987 Tsutsui ..... C10M 107/08 585/10
8,410,035 B2 4/2013 Kaneshige et al.
(Continued)

FOREIGN PATENT DOCUMENTS

CN 1340091 A 3/2002
CN 102209770 A 10/2011
(Continued)

OTHER PUBLICATIONS

ExxonMobil Group II/II+ EHC Base Stocks Data Sheet (Year: 2003).*
(Continued)

*Primary Examiner* — Vishal V Vasisth
(74) *Attorney, Agent, or Firm* — Melissa M. Hayworth; E. Joseph Gess

(57) ABSTRACT

Described herein is a process, comprising: a) selecting an API Group II base stock with selected viscosity index and pour point; b) blending a base oil with the base stock, and c) adding to the base oil: i) a liquid ethylene propylene copolymer viscosity modifier that reduces a traction coefficient, and ii) an additive package, to make a driveline fluid that has a defined viscosity index and excellent shear stability. Also provided is a driveline fluid composition having the high viscosity index and excellent shear stability, com-
(Continued)

prising: a) a base oil comprising from 50 wt % to 100 wt % API Group II base stock; b) a liquid ethylene propylene copolymer viscosity modifier that reduces a traction coefficient; and c) an additive package. Further provided is a method for lubricating an axle or manual transmission by supplying the driveline fluid composition.

23 Claims, 2 Drawing Sheets

(51) Int. Cl.

| | |
|---|---|
| ***C10M 143/04*** | (2006.01) |
| *C10N 20/02* | (2006.01) |
| *C10N 20/00* | (2006.01) |
| *C10N 30/02* | (2006.01) |
| *C10N 30/08* | (2006.01) |
| *C10N 30/10* | (2006.01) |
| *C10N 30/12* | (2006.01) |
| *C10N 30/00* | (2006.01) |
| *C10N 40/04* | (2006.01) |

(52) U.S. Cl.
CPC ..... *C10M 2203/003* (2013.01); *C10M 2203/1006* (2013.01); *C10M 2203/1025* (2013.01); *C10M 2205/022* (2013.01); *C10M 2205/024* (2013.01); *C10M 2205/0285* (2013.01); *C10M 2209/084* (2013.01); *C10N 2020/011* (2020.05); *C10N 2020/02* (2013.01); *C10N 2030/02* (2013.01); *C10N 2030/08* (2013.01); *C10N 2030/10* (2013.01); *C10N 2030/12* (2013.01); *C10N 2030/36* (2020.05); *C10N 2030/68* (2020.05); *C10N 2040/04* (2013.01); *C10N 2040/044* (2020.05)

(58) Field of Classification Search
CPC ..... C10N 2230/02; C10N 2230/68; C10N 2240/044; C10N 2220/022; C10N 2020/019; C10N 2030/68; C10N 2040/046; C10N 2020/02; C10N 2030/02
See application file for complete search history.

(56) References Cited

U.S. PATENT DOCUMENTS

2005/0261146 A1* 11/2005 Rosenbaum ..... C10M 169/041 508/466
2007/0078070 A1* 4/2007 Shirazi ..... C10G 50/02 508/591

FOREIGN PATENT DOCUMENTS

| | | | |
|---|---|---|---|
| EP | 1561798 | A1 | 8/2005 |
| EP | 2837676 | A1 | 2/2015 |
| JP | 5564204 | B2 | 7/2014 |
| WO | 2001042401 | A1 | 6/2001 |
| WO | 2006101206 | A1 | 9/2006 |
| WO | 2010039399 | A2 | 4/2010 |
| WO | 2013154005 | A1 | 12/2015 |

OTHER PUBLICATIONS

International Search Report and Written Opinion from PCT/US2016/044579 dated Sep. 15, 2016.
Office Action dated Jul. 14, 2020 issued in corresponding JP application No. 2019-504805.
Decision to Grant a European Patent dated Sep. 4, 2020 issued in corresponding European Application No. 16748008.6.
English translation of Office Action dated May 28, 2021 issued in corresponding Chinese application No. 201680087955.2.

* cited by examiner

DRIVELINE FLUIDS COMPRISING API GROUP II BASE OIL

This application is a national stage filing under 35 U.S.C. § 371 of International Application No. PCT/US2016/044579 filed 28 Jul. 2016, entitled "Driveline Fluids Comprising API Group II Base Oil", the contents of which are hereby incorporated by reference in their entirety.

TECHNICAL FIELD

This application is directed to driveline fluids with excellent viscometric properties and improved shear stability.

BACKGROUND

It is commonly accepted in the lubricants industry that high-performance base oils, notably those in API Groups III, IV, and other synthetics, are needed to meet performance specifications for modern driveline fluids. This is because today's advanced driveline fluids require exceptional performance in the following areas: low temperature fluidity, viscosity index, traction coefficient (a measure of energy efficiency), shear stability, and oxidation and thermal stability (needed, among other reasons, for long drain applications). Those skilled in the art know that the use of API Groups III, IV, and other synthetic base oils in finished driveline lubricants will lead to excellent performance in the aforementioned areas. In fact, base oils comprised with a majority of Group II base stocks are not used to formulate modern driveline fluids because Group II base oils show inferior performance compared to Groups III, IV, and other synthetics in the areas of low temperature fluidity, traction coefficient, viscosity index, and oxidation and thermal stability.

For example, U.S. Pat. No. 8,410,035 teaches the use of viscosity modifiers for power transmission oils. The range of properties claimed for the base oil in such finished lubricants specifically excludes the property range common to API Group II base stocks, such as those manufactured by Chevron. However, there is a strong impetus to use Group II base oil because such oil is available in larger quantities and at lower cost compared to API Groups III, IV, and other synthetics. This publication discloses novel and surprising results which allow the use of a majority of Group II base stocks in driveline fluids, while preserving equal or better performance compared to finished fluids comprising a majority of Groups III, IV, or other synthetics. In particular, we disclose methods which give equivalent traction coefficients, low temperature fluidity, shear stability and viscosity index. The fluids made with a majority of Group II base stock are also suitable for extended or long drain applications, similar to fluids made with Groups III, IV, or other synthetics.

SUMMARY

This application provides a process for blending a driveline fluid. This process comprises selecting at least one API Group II base stock having a viscosity index from 90 to 119 and a pour point from −19° C. to 0° C.; blending a base oil comprising 50 to 100 wt % of the at least one API Group II base stock; and adding to the base oil 5 to 30 wt % of a viscosity modifier that is a liquid ethylene propylene copolymer, wherein the viscosity modifier reduces a traction coefficient of the driveline fluid; and an additive package designed for the driveline fluid, to make the driveline fluid; wherein the driveline fluid has a driveline fluid viscosity index of 140 to 180 and has a percentage loss of kinematic viscosity at 100° C. in a 20 hour KRL shear stability test of less than 5.5%.

This application also provides a driveline fluid composition. This composition comprises a base oil comprising from 50 wt % to 100 wt % of at least one API Group II base stock having a viscosity index from 90 to 119 and a pour point from −19° C. to 0° C.; 5 to 30 wt % of a viscosity modifier that is a liquid ethylene propylene copolymer that reduces a traction coefficient of the driveline fluid; and an additive package designed for a driveline fluid, wherein the driveline fluid composition has a driveline fluid viscosity index of 140 to 180 and has a percentage loss of kinematic viscosity at 100° C. in a 20 hour KRL shear stability test of less than 5.5%.

This application also provides a method for lubricating a mechanical device. This method comprises supplying to the mechanical device a driveline fluid composition, comprising a base oil comprising at least 50 wt % to 100 wt % of an API Group II base stock having a viscosity index from 90 to 119 and a pour point from −19° C. to 0° C.; 5 to 30 wt % of a viscosity modifier that is a liquid ethylene propylene copolymer that reduces a traction coefficient of the driveline fluid; and an additive package designed for a driveline fluid, wherein the driveline fluid composition has: a driveline fluid viscosity index of 140 to 180 and a percentage loss of kinematic viscosity at 100° C. in a 20 hour KRL shear stability test of less than 5.5%; and wherein the mechanical device is an axle or a manual transmission.

The present invention may suitably comprise, consist of, or consist essentially of, the elements in the claims, as described herein.

GLOSSARY

Figure 1:
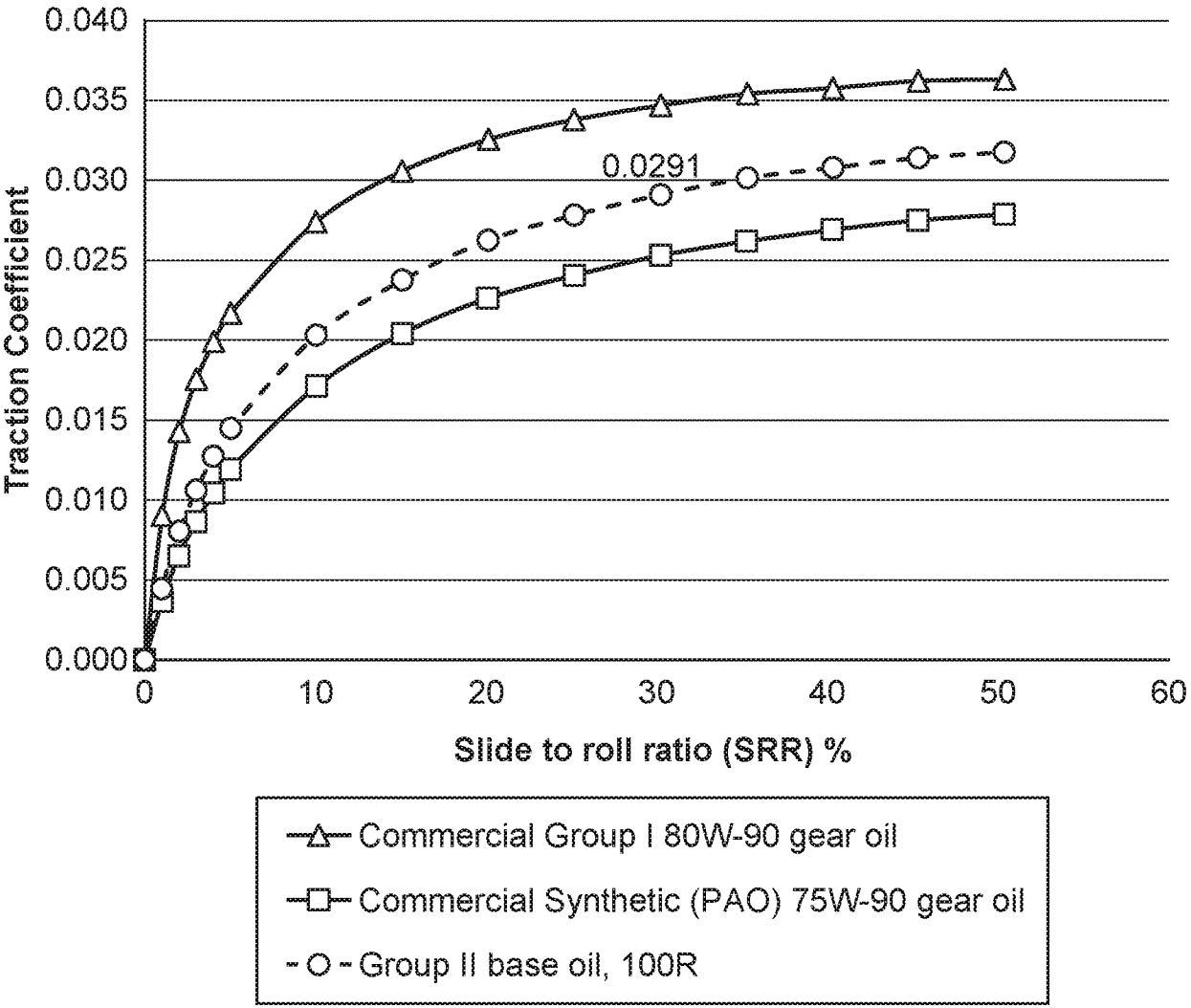
FIG. 1 is a chart of MTM traction coefficients that were measured on different base stocks. As shown, API Group II base stock showed higher traction coefficients compared to commercial fluids which were based on synthetic base stocks, but lower traction coefficients compared to API Group I base stocks.

"Driveline fluid" refers to lubricating oils used in gears and transmissions in vehicles. Examples of driveline fluids include: axle lubricants, manual transmission fluids, and various automatic transmission fluids such as stepped automatic, continuously variable, and dual clutch.

"Base stock" refers to a lubricant component that is produced by a single manufacturer to the same specifications (independent of feed source or manufacturer's location): that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining.

"Base oil" refers to a base stock, or a blend of base stocks, used in a finished lubricant. A finished lubricant is a product which is either packaged or sold in bulk to end users and/or distributors for use in equipment that requires a lubricant.

"API Base Oil Categories" are classifications of base oils that meet the different criteria shown in Table 1:

TABLE 1

| API Group | Sulfur, wt % | | Saturates, wt % | Viscosity Index |
|---|---|---|---|---|
| I | >0.03 | and/or | <90 | 80-119 |
| II | <0.03 | and | >90 | 80-119 |
| III | <0.03 | and | >90 | >120 |
| IV | All Polyalphaolefins (PAOs) | | | |
| V | All base oils not included in Groups I-IV(naphthenics, non-PAO synthetics) | | | |

"Group II+" is an unofficial, industry-established 'category' that is a subset of API Group II base oils that have a VI greater than 110, usually 112 to 119.

"Multi-graded" refers to lubricants that are blended with polymeric viscosity modifiers to meet two different viscosity specifications. The viscosity grade of multi-graded lubricants consists of two numbers, e.g. 75W-85: 75W refers to the low-temperature viscosity ("Winter") and 85 refers to the high-temperature viscosity ("Summer"). Viscosity grades for gear oils and driveline fluids are defined by SAE J 306.

"Kinematic viscosity" refers to the ratio of the dynamic viscosity to the density of an oil at the same temperature and pressure, as determined by ASTM D445-15.

"Viscosity modifier" refers to a polymeric additive that is blended into a base oil to offset the thinning of the base oil as the temperature is increased. The result of including a viscosity modifier in a blended finished lubricant is that a relatively stable kinematic viscosity over a wide temperature range is achieved.

"Shear stability" refers to the ability of a multi-graded finished lubricant to resist permanent viscosity loss during use. The method used herein to determine shear stability is the 20 hour KRL shear stability test by CEC-L-45, and the results reported are those at 100° C. KRL is a mechanical shearing method.

"Viscosity index (VI)" refers to a measure for the change of viscosity with variations in temperature. The lower the VI, the greater is the change of viscosity of the oil with temperature and vice versa. VI is determined by ASTM D2270-10 (E 2011).

"API gravity" refers to the gravity of a petroleum feedstock or product relative to water, as determined by ASTM D4052-11.

DETAILED DESCRIPTION

The process for blending a driveline fluid comprises selecting at least one API Group II base stock having a viscosity index from 90 to 119 and a pour point from −19° C. to 0° C. These types of base stocks are readily available, worldwide.

Examples of API Group II base stocks manufactured by Chevron that can be used to blend the driveline fluid include Chevron™ 60R, Chevron™ 100R, Chevron™ 150R, Chevron™ 220R, Chevron™ 600R, and Chevron™ 110RLV.

Chevron 100R refers to an API Group II base stock with the properties of Table 2.

TABLE 2

| Specification Test | Parameter | Unit of Measure | Test Method | Min | Max | Typical |
|---|---|---|---|---|---|---|
| Appearance, Odor and Texture | | | OBSERVATION | | | |
| Appearance | | | OBSERVATION | Clear & Bright | | |
| API Gravity | | ° API | ASTM D4052 | | | 34.7 |
| Density | 15° C. | kg/L | ASTM D1298 | | | 0.8505 |
| Flash Point, COC | | ° C. | ASTM D92 | 192 | | 206 |
| Kinematic Viscosity | 40° C. | $mm^2/s$ | ASTM D445 | 18.70 | 20.80 | 19.6 |
| Kinematic Viscosity | 100° C. | $mm^2/s$ | ASTM D445 | Report | | 4.05 |
| Apparent Viscosity, CCS | −20° C. | cP | ASTM D5293 | | 1550 | 1325 |
| Viscosity Index | | | ASTM D2270 | 95 | | 103 |
| Sulfur | | mg/kg | ASTM D7039 | | | <6 |
| ASTM Color | | | ASTM D1500 | | 1.0 | L0.5 |
| Pour Point | | ° C. | ASTM D5950 | | −12 | −15 |
| Water Content | | mg/kg | ASTM D6304 | Report | | |

Chevron 220R refers to an API Group II base stock with the properties of Table 3.

TABLE 3

| Specification Test | Parameter | Unit of Measure | Test Method | Min | Max | Typical |
|---|---|---|---|---|---|---|
| Appearance, Odor and Texture | | | OBSERVATION | | | |
| Appearance | | | OBSERVATION | Clear & Bright | | |
| API Gravity | | ° API | ASTM D4052 | | | 31.9 |
| Density | 15° C. | kg/L | ASTM D1298 | | | 0.8655 |
| Flash Point, COC | | ° C. | ASTM D92 | 212 | | 230 |
| Kinematic Viscosity | 40° C. | $mm^2/s$ | ASTM D445 | 40.00 | 46.00 | 43.7 |
| Kinematic Viscosity | 100° C. | $mm^2/s$ | ASTM D445 | Report | | 6.60 |

TABLE 3-continued

| Specification Test | Parameter | Unit of Measure | Test Method | Min | Max | Typical |
|---|---|---|---|---|---|---|
| Apparent Viscosity, CCS | −20° C. | cP | ASTM D5293 | | 3600 | 3400 |
| Viscosity Index | | | ASTM D2270 | 95 | | 102 |
| Sulfur | | mg/kg | ASTM D7039 | | | <10 |
| ASTM Color | | | ASTM D1500 | | 1.5 | L0.5 |
| Pour Point | | ° C. | ASTM D5950 | | −12 | −13 |
| Water Content | | mg/kg | ASTM D6304 | Report | | |
| Noack Evaporation Loss, Proc B | 1 h, 250° C. | mass % | ASTM D5800 | | 12 | 10 |
| Density | 60° F. (15.56° C.) | lb/gal | ASTM D1298 | Report | | 7.216 |

Chevron API Group II Base Stocks have the typical properties shown in Table 5. All of them, except for Chevron 60R, can be used alone to make the driveline fluid. Or, any of them, including Chevron 60R, can be blended together to make the driveline fluid.

TABLE 4

| Property/base oil | ASTM Methods | 60R | 100R | 150R | 220R | 600R | 110RLV |
|---|---|---|---|---|---|---|---|
| API gravity, deg | D4052 | 32.1 | 34.4 | 33.7 | 31.9 | 31.2 | 35.4 |
| Color | D1500 | L0.5 | L0.5 | L0.5 | L0.5 | L0.5 | L0.5 |
| Density, lb/gal | D4052 | 7.217 | 7.1 | 7.132 | 7.22 | 7.28 | 7.059 |
| Specific gravity @ 60 F./60 F. | D4052 | 0.865 | 0.858 | 0.857 | 0.866 | 0.874 | 0.848 |
| Kinematic Viscosity @ 40° C., $mm^2/s$ | D445 | 10.5 | 19.6 | 29.4 | 43.7 | 108 | 20.32 |
| Kinematic Viscosity @ 100° C., $mm^2/s$ | D445 | 2.6 | 4.1 | 5.24 | 6.6 | 12.2 | 4.28 |
| Kinematic Viscosity @ 100° F. (37.78° C.), SUS | D2161 | 63 | 107 | 153 | 214 | 590 | 113 |
| Viscosity Index | D2270 | 70 | 102 | 109 | 102 | 103 | 118 |
| CCS @ −20° C., cP | D5293 | — | — | 1500 | 3400 | — | 822 |
| CCS @ −25° C., cP | D5293 | — | 1400 | 2660 | 5600 | — | 1100 |
| CCS @ −30° C., cP | D5293 | — | 2650 | 5070 | — | — | 2450 |
| Pour Point, ° C. | D5950/1C | −45 | −15 | −13 | −13 | −17 | −15 |
| Flash point, COC, ° C. | D92 | 170 | 206 | 220 | 230 | 270 | 216 |
| Noack volatility, wt % evap. loss | D5800, Proc B | — | 26 | 14.5 | 10 | 2 | 16 |
| Sulphur, ppm | D7039 (ICP/XRF) | <10 | <10 | <6 | <10 | <10 | <6 |
| Aromatics, HPLC, wt % | Chevron | 1 | <1 | <1 | <1 | <1 | <1 |

The Chevron method used to measure aromatics is described in US Patent Publication 20140274828.

In one embodiment, the at least one API Group II base stock has a kinematic viscosity at 40° C. from 15 to 28 $mm^2/s$. An example of this type of API Group II base stock is Chevron Group II base oil, 100R.

The process includes blending a base oil comprising 50 to 100 wt % of the at least one API Group II base stock.

In one embodiment, the base oil comprises two different API Group II base stocks. For example, the base oil can comprise a first API Group II base stock having a kinematic viscosity at 40° C. from 15 to 25 $mm^2/s$ and a second API Group II base stock having a higher kinematic viscosity at 40° C. from 40 to 46 $mm^2/s$. Examples of these two different API Group II base stocks are Chevron 100R and Chevron 220R, both of which are commercially available in the US West Coast, US Gulf Coast, Latin America, Europe, Asia Pacific, and Africa.

In one embodiment, the at least one API Group II base stock has a viscosity index from 90 to 109. In another embodiment, the base oil comprises two different API Group II base stocks, both of which have a viscosity index from 90 to 109.

In one embodiment, the base oil selected for the driveline fluid additionally comprises an API Group IV base stock. In one embodiment, the API Group IV base stock has a PAO kinematic viscosity at 100° C. from 3 to 5 $mm^2/s$ and a PAO viscosity index of 115 to 130. Examples of these types of API Group IV base stocks are Synfluid® PAO 4 cSt, supplied by Chevron Phillips Chemical, and SpectraSyn™ Lo Vis PAO 4, supplied by ExxonMobil. In another embodiment, a synthetic ester base stock may be present.

The sample of PAO-4 in the context of this disclosure refers to an API Group IV base stock with the typical properties summarized in Table 5.

TABLE 5

| Specification Test | Parameter | Unit of Measure | Test Method | Typical |
|---|---|---|---|---|
| Appearance | | | OBSERVATION | Clear |
| API Gravity | | °API | ASTM D4052 | 41.3 |
| Density | 15° C. | kg/L | ASTM D1298 | 0.8177 |
| Flash Point, COC | | ° C. | ASTM D92 | 216 |
| Kinematic Viscosity | 40° C. | $mm^2/s$ | ASTM D445 | 16.77 |
| Kinematic Viscosity | 100° C. | $mm^2/s$ | ASTM D445 | 3.82 |
| Apparent Viscosity, CCS | −20° C. | cP | ASTM D5293 | 1180 |
| Viscosity Index | | | ASTM D2270 | 120 |
| Sulfur | | mg/kg | ASTM D7039 | 0 |
| Noack Evaporation Loss, Proc B | 1 h, 250° C. | mass % | ASTM D5800 | 15.9 |

TABLE 5-continued

| Specification Test | Parameter | Unit of Measure | Test Method | Typical |
|---|---|---|---|---|
| Density | 60° F. (15.56° C.) | lb/gal | ASTM D1298 | |

In one embodiment, the process steps of selecting, blending, and adding provide a multi-grade lubricant as defined in SAE J 306, 2005. The viscosity requirements for SAE J 306 are shown in Table 6.

TABLE 6

Automotive Lubricant Viscosity Grades: Gear Oils—From SAE J 306, 2005

| SAE Viscosity Grade | Max. Temperature for 150 000 cP [° C.] (ASTM D 2983) | Min. Viscosity [$mm^2/s$] at 100° C. (ASTM D445) | Max. Viscosity [$mm^2/s$] at 100° C. (ASTM D445) |
|---|---|---|---|
| 70 W | −55 | 4.1 | — |
| 75 W | −40 | 4.1 | — |
| 80 W | −26 | 7.0 | — |
| 85 W | −12 | 11.0 | — |
| 80 | — | 7.0 | <11.0 |
| 85 | — | 11.0 | <13.5 |
| 90 | — | 13.5 | <18.5 |
| 110 | — | 18.5 | <24.0 |
| 140 | — | 24.0 | <32.5 |
| 190 | — | 32.5 | <41.0 |
| 250 | — | 41.0 | — |

In one embodiment, the driveline fluid is an SAE viscosity grade of 75W-85. In one embodiment, the driveline fluid meets the SAE J2360 standard. SAE J2360 is a standard set by SAE International for automotive gear lubricants for commercial and military use. The gear lubricants covered by SAE J2360 exceed American Petroleum Institute (API) Service Classification API GL-5 and are intended for hypoid type, automotive gear units, operating under conditions of high-speed/shock load and low-speed/high-torque. The most recent revision to the SAE J2360 standard published on Apr. 25, 2012.

API Category GL-5 designates the type of service characteristic of gears, particularly hypoids in automotive axles under high-speed and/or low-speed, high-torque conditions. Lubricants qualified under U.S. Military specification MIL-L-2105D (formerly MIL-L-2015C), MIL-PRF-2105E and SAE J2360 satisfy or exceed the requirements of the API Category GL-5 service designation. The requirements for the API Category GL-5 are defined in "Lubricant Service Designations for Automotive Manual Transmissions, Manual Transaxles, and Axles", Eighth Edition, April 2013. The performance specifications for API GL-5 are defined in ASTM D7450-13.

Viscosity Modifier:

The process for blending a driveline fluid comprises adding a viscosity modifier to the base oil. The viscosity modifier is a liquid ethylene propylene copolymer that reduces a traction coefficient of the driveline fluid.

From 5 to 30 wt % of the viscosity modifier that is a liquid ethylene propylene copolymer is added to the base oil. In one embodiment, 11 to 25 wt % of the viscosity modifier is added to the base oil. The viscosity modifier provides highly effective thickening for the driveline fluid while also giving excellent shear stability. In one embodiment, the wt % of the viscosity modifier that is a liquid ethylene propylene copolymer is significantly less than the wt % of an alternative viscosity modifier to achieve the same viscometrics of the driveline fluid. For example, the amount of the liquid ethylene propylene copolymer can be from 30% to 65% of the amount of alternative types of viscosity modifiers to achieve approximately the same viscometrics.

Figure 2:
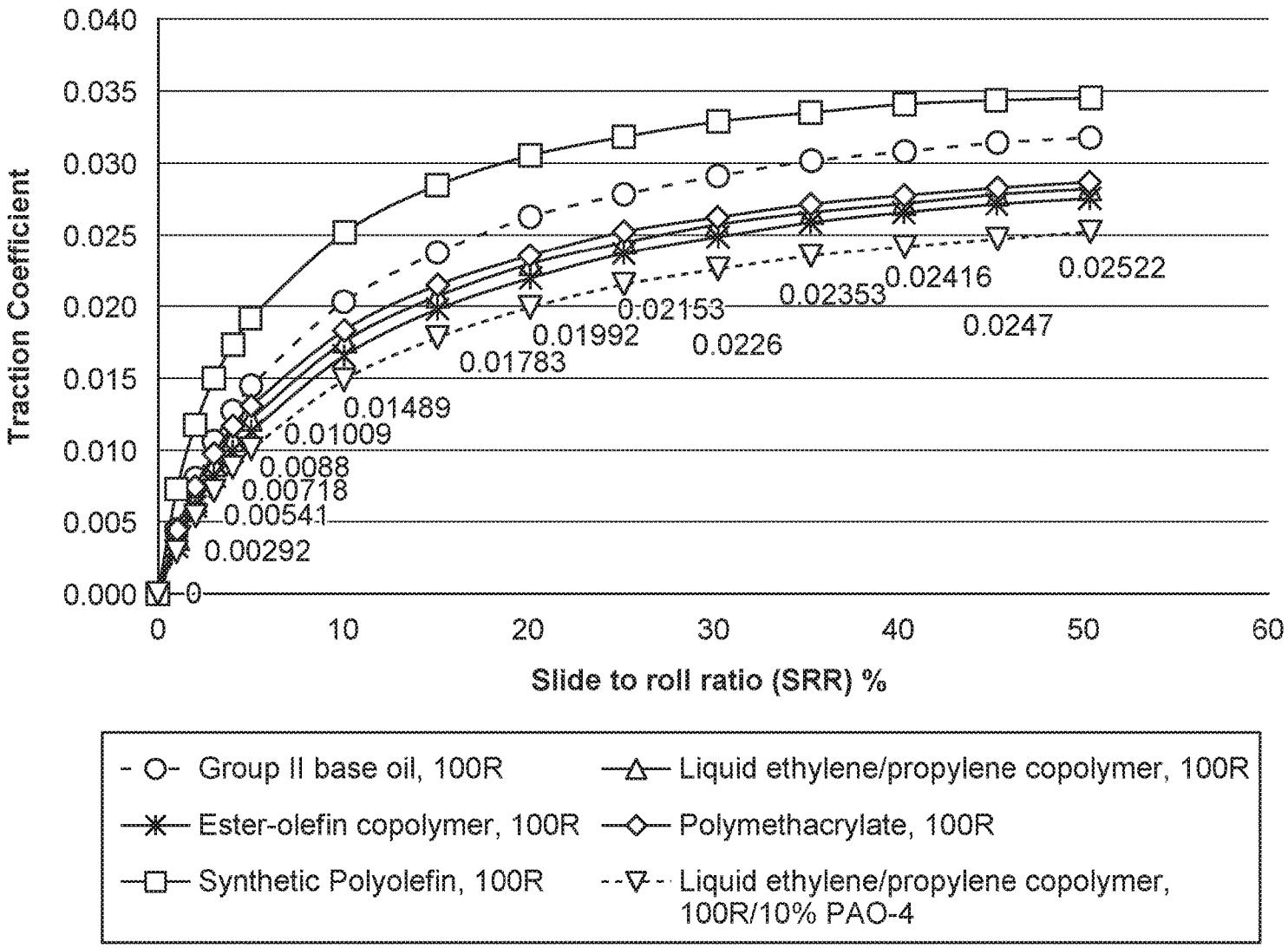
FIG. 2 is a chart of MTM traction coefficients that were measured on preliminary driveline fluid blends to assess the effects of different viscosity modifiers.

Advantageously, the viscosity modifier significantly reduces the traction coefficient of the driveline fluid. This effect had not been previously achieved in a driveline fluid comprising a base oil predominantly made of one or more API Group II base stocks. The viscosity modifier reduces a traction coefficient of the driveline fluid, as evidenced in a MTM traction measurement system. For example, compared to a similar blend of the driveline fluid with the same base oil and additive package, but without a viscosity modifier, the traction coefficient can be reduced by greater than 0.002 when measured in a MTM traction measurement system at 120° C., with a 30% slide to roll ratio, and at a load of 72 Newton. The effect of reducing the traction coefficient is demonstrated in FIG. 2. In one embodiment the traction coefficient when measured under these conditions is reduced by 0.002 to 0.008 compared to the similar blend of the driveline fluid.

Liquid ethylene propylene copolymers have a melting point, as measured by differential scanning calorimetry, less than 60° C. The melting point is measured from an endothermic curve, measured by heating about 5 mg of sample packed in an aluminum pan to 200° C., holding for five minutes at 200° C., cooling to −40° C., at a rate of 10° C. per minute, holding for five minutes at −40° C., and raising a temperature at a rate of 10° C. per minute. In one embodiment, the viscosity modifier additionally has one or more of the properties selected from the group of: an ethylene content from 45 to 60 mol %, a Mw/Mn of 1.0 to 2.3, and an intrinsic viscosity [η] from 0.2 to 1.0 dl/g. The ethylene content of the viscosity modifier is measured by $^{13}$C-NMR according to the method described in "Handbook of Polymer Analysis (Kobunshi Bunseki Handbook)", pages 163-170. The weight average molecular weight (Mw) and the number average molecular weight (Mn) are measured by gel permeation chromatography (GPC) at 140° C. in ortho-dichlorobenzene. The intrinsic viscosity [η] is measured in decalin (decahydronaphthalene) at 135° C. Examples of these types of viscosity modifiers are described in U.S. Pat. No. 8,410,035.

In one embodiment, the traction coefficient of the driveline fluid is less than 0.029 when measured in a MTM traction measurement system at 120° C., with a 30% slide to roll ratio, and at a load of 72 Newton. For example, the traction coefficient can be from 0.019 to 0.028 when measured in a MTM traction measurement system at 120° C., with a 30% slide to roll ratio, and at a load of 72 Newton. In one embodiment, the adding of the viscosity modifier to the base oil reduces the traction coefficient of the driveline fluid to 0.026 or less when measured in a MTM traction measurement system at 120° C., with a 30% slide to roll ratio, and at a load of 72 Newton.

Traction Coefficient Test Method:

Traction data were obtained with an MTM Traction Measurement System from PCS Instruments, Ltd. The unit was configured with a polished 19 mm diameter ball (SAE AISI 52100 steel) loaded against a flat 46 mm diameter polished disk (SAE AISI 52100 steel). Measurements were made at various temperatures including 100 and 120° C. The steel ball and disk were driven independently by two motors at an average rolling speed of 2.5 meters/sec and a slide to roll ratio (SRR) of 0 to 50% [defined as the difference in sliding speed between the ball and disk divided by the mean speed of the ball and disk. SRR=(Speed1−Speed2)/

((Speed1+Speed2)/2)]. The load on the ball/disk was 72 Newton resulting in a maximum Hertzian contact stress of 1.25 GPa.

Additive Package Designed for the Driveline Fluid:

An additive package designed for the driveline fluid is also added to the base oil to make the driveline fluid. Optionally, a pour point depressant may also be added to the base oil, if the additive package does not reduce the pour point of the driveline fluid to an acceptable level.

Pour Point Depressant:

Examples of the pour point depressant that can be used include polymers or copolymers of alkyl methacrylate, polymers or copolymers of alkyl acrylate, polymers or copolymers of alkyl fumarate, polymers or copolymers of alkyl maleate, and alkyl aromatic compounds. Among them, a polymethacrylate pour point depressant that is a pour point depressant comprising polymers or copolymers of alkyl methacrylate can be used. In one embodiment, a carbon number of an alkyl group of the alkyl methacrylate is from 12 to 20. When added, a content of the pour point depressant can be from 0.05 to 2% by weight of the total composition of the driveline fluid. Examples of commercially available pour point depressants that can be used include: ACLUBE™ 146 and ACLUBE™ 136, manufactured by Sanyo Chemical Industries, Ltd.; LUBRAN™ 141 and LUBRAN™ 171 manufactured by TOHO Chemical Industry Co., Ltd; LUBRIZOL™ 6662 manufactured by Lubrizol; and VISCOPLEX® 1-330 manufactured by Evonik Industries.

In some embodiments, the pour point depressant contains a solvent in addition to the polymer or copolymer. The content of the pour point depressant added into the driveline fluid of 0.05 to 2% by weight refers to an amount including such a solvent.

Finished lubricant additive suppliers such as Infineum, Lubrizol, Oronite, and Afton supply, or have supplied, additive packages designed for driveline fluids that will meet API Category GL-5.

In one embodiment, the additive package designed for the driveline fluid comprises performance additives selected from the group of antioxidants, dispersants, detergents, corrosion inhibitors, rust inhibitors, metal deactivators, antiwear agents, anti-seizure agents, wax modifiers, viscosity index improvers, seal compatibility agents, friction modifiers, lubricity agents, anti-staining agents, chromophoric agents, defoamants, demulsifiers, emulsifiers, densifiers, wetting agents, gelling agents, tackiness agents, colorants, and combinations thereof. Details on different performance additives that can be included in an additive package designed for driveline fluids are given in "Lubricant Additives: Chemistry and Applications, Second Edition", edited by Leslie R. Rudnick, 2009.

Some examples of antioxidants include phenolic antioxidants, aromatic amine antioxidants, and oil-soluble copper compounds.

Some examples of detergents include alkali or alkaline earth metal salicylate detergents, alkali and alkaline earth metal phenates, sulfonates, carboxylates, phosphonates and mixtures thereof. Some of these detergents also function as dispersants. Examples of detergent dispersants include sulfonate dispersants such as calcium sulfonate and magnesium sulfonate; phenates, salicylates; succinimides; and benzylamines.

Other examples of dispersants include ashless dispersants that are non-metal containing or borated and don't form ash upon combustion. Examples of ashless dispersants include alkenylsuccinic derivates, succinimide, succinate esters, succinate ester amides, Mannich base dispersants, and the like.

Some examples of corrosion inhibitors include benzotriazole-based, thiadiazole-based, and imidazole-based compounds.

Some examples of rust inhibitors include carboxylic acids, carboxylates, esters, phosphoric acids, and various amines.

Some examples of antiwear agents include phosphates, phosphites, carbamates, esters, sulfur containing compounds, and molybdenum complexes. Specific examples include zinc dialkyldithiophosphate, zinc diaryldithiophosphate, Zn or Mo dithiocarbamates, amine phosphites, amine phosphates, borated succinimide, magnesium sulfonate, and mixtures thereof. In one embodiment, the antiwear agent comprises an extreme-pressure agent. Examples of extreme-pressure agents include sulfurized oil and fat, sulfurized olefins, sulfides, alkaline earth metal borated agents, alkali metal borated agents, zinc dialkyl-1-dithiophosphate (primary alkyl, secondary alkyl, and aryl-type), di-phenyl sulfide, methyl trichlorostearate, chlorinated naphthalene, fluoroalkylpolysiloxane, lead naphthenate, sulfur-free phosphates, di-thiophosphates, phosphite, amine phosphate, and amine phosphite.

Some examples of friction modifiers include organomolybdenum compounds such as molybdenum dithiophosphate and molybdenum dithiocarbamate.

Some examples of defoamants include silicon-based antifoaming agents such as dimethylsiloxane and silica gel dispersion agents; alcohol- and ester-based antifoaming agents; and acrylate polymers. In one embodiment, the defoamant can be a mixture of polydimethyl siloxane and fluorosilicones. In one embodiment, the silicon-based antifoaming agent can be selected from the group consisting of fluorosilicones, polydimethylsiloxane, phenyl-methyl polysiloxane, linear siloxanes, cyclic siloxanes, branched siloxanes, silicone polymers and copolymers, organo-silicone copolymers, and mixtures thereof.

Some of the above-mentioned performance additives can provide a multiplicity of effects. These multifunctional performance additives are well known. The performance additives are blended together into the additive package designed for the driveline fluid such that the amount of the performance additives, when blended into the driveline fluid, will provide their desired functions.

The total amount of the additive package designed for the driveline fluid in the fully formulated driveline fluid is from 5 to 20 wt %. In one embodiment, the additive package designed for the driveline fluid is added to the base oil in an amount from 8 to 13 wt %.

Driveline Fluid Composition

The driveline fluid can be made by the processes described herein. The driveline fluid composition has a driveline fluid viscosity index of 140 to 180 and has a percentage loss of kinematic viscosity at 100° C. in a 20 hour KRL shear stability test of less than 5.5%. In one embodiment, the percentage loss of kinematic viscosity at 100° C. in the 20 hour KRL shear stability test is from 1% to 5.5%.

The driveline fluid comprises a base oil that comprises from 50 wt % to 100 wt % of at least one API Group II base stock having a viscosity index from 90 to 119 and a pour point from −19° C. to 0° C.

In one embodiment, the at least one API Group II base stock has a kinematic viscosity at 40° C. from 15 to 28 $mm^2/s$. In one embodiment, the base oil comprises two different API Group II base stocks. For example, the base oil can comprise a first API Group II base stock having a kinematic viscosity at 40° C. from 15 to 25 $mm^2/s$ and a second API Group II base stock having a higher kinematic viscosity at 40° C. from 40 to 46 $mm^2/s$.

In one embodiment, the at least one API Group II base stock has a viscosity index from 90 to 109. In another embodiment, the base oil comprises two different API Group II base stocks, both of which have a viscosity index from 90 to 109.

In one embodiment, the base oil in the driveline fluid composition additionally comprises a minor amount of an API Group IV base stock. For example, the base oil can comprise less than 20 wt % API Group IV base stocks, such as from zero to 15 wt % API Group IV base stock.

The driveline fluid additionally comprises 5 to 30 wt %, such as 11 to 20 wt %, of a viscosity modifier that is a liquid ethylene propylene copolymer that reduces a traction coefficient of the driveline fluid. In one embodiment, the driveline fluid composition has a traction coefficient less than 0.029, for example from 0.019 to 0.028, when measured in a MTM traction measurement system at 120° C., with a 30% slide to roll ratio, and at a load of 72 Newton. In one embodiment, the traction coefficient can be 0.026 or less.

Also, the driveline fluid composition comprises an additive package designed for the driveline fluid, as described earlier.

In one embodiment, the driveline fluid is a multi-grade gear oil, such as an SAE viscosity grade 75W-85.

In one embodiment, the base oil in the driveline fluid comprises 50 to 70 wt % Chevron Group II base oil, 220R, 20 to 50 wt % Chevron Group II base oil, 100R, and 0 to 15 wt % PAO-4. Alternatively, the base oil in the driveline fluid comprises 20 to 50 wt % of a first API Group II base stock having a kinematic viscosity at 40° C. from 15 to 25 $mm^2/s$, 50 to 70 wt % of a second API Group II base stock having a higher kinematic viscosity at 40° C. from 40 to 46 $mm^2/s$, and 0 to 15 wt % of an API Group IV base stock having a PAO kinematic viscosity at 100° C. from 3 to 5 $mm^2/s$ and a PAO viscosity index from 115 to 119.

In one embodiment, the driveline fluid has excellent thermal and oxidative stability, enabling it to be used in higher operating temperatures in transmissions and drive axles. In one embodiment the driveline fluid gives a viscosity increase less than 80% in the L-60-1 test. In one embodiment, the adding of the viscosity modifier to the base oil increases the thermal and oxidative stability of the driveline fluid to give 5 to 50% viscosity increase in a L-60-1 test. The L-60-1 test is performed according to ASTM D5704-15a and determines the oil-thickening, insolubles-formation, and deposit-formation characteristics of automotive manual transmission and final drive axle lubricating oils when subjected to high-temperature oxidizing conditions. The high thermal and oxidative stability can make the driveline fluid suitable for use in applications with higher operating temperatures than is possible with earlier driveline fluids made using API Group II base stocks. The special characteristics of the driveline fluid can lead to a reduction in the operating temperature, further extending the service capability of the driveline fluid in arduous operating conditions, or improving its fuel economy in normal service conditions.

In one embodiment, the driveline fluid is capable of significantly longer service intervals than earlier driveline fluids made using API Group II base stocks: up to twice as long in transmissions and more than three times as long in drive axles. An example of an earlier driveline fluid made using API Group II base stock is a commercial Group I 80W-90 gear oil, such as Chevron MULTIGEAR® EP-5, SAE 80W-90.

We also provide a method for lubricating a mechanical device, comprising: supplying to the mechanical device the driveline fluids described herein. Examples of the mechanical devices include axles and manual transmissions. The benefits that can be realized include one or more of: reduced transmission power loss, excellent viscosity index, better low temperature fluidity, improved thermal and oxidative stability, increased drain intervals, and higher shear stability; properties previously only achieved when blending driveline fluids with predominantly (comprising greater than 50 wt %) API Group III or API Group IV base oils.

EXAMPLES

Example 1: Preliminary Blends to Assess Effects of Viscosity Modifiers on Traction Coefficient Traction coefficients were measured and plotted on a series of fully formulated driveline fluids and base oil blends with different viscosity modifiers. MTM traction coefficients were measured over a range of slide to roll ratios (SRR) from 0 to 50, at 72N and 2.5 m/s in a MTM traction measurement system as described herein. The MTM traction coefficient results on some of these driveline fluids and test samples are summarized in FIG. 1. As was expected, the earlier commercial driveline fluids blended with either API Group III or Group IV base oils showed significantly lower traction coefficients compared to those blended with API Group II base stocks.

A sample of a commercial synthetic (PAO) 75W-90 gear oil, such as Chevron MULTIGEAR® S 75W-90, blended with API Group IV base oil (PAO-4) and using a synthetic polyolefin, for comparison, had a very low traction coefficient at a slide to roll ratio of 30% of about 0.0255. A sample of a commercial Group I 80W-90 gear oil, such as Chevron MULTIGEAR® EP-5 SAE 80W-90, blended with API Group II base stock had comparatively high traction coefficients. MULTIGEAR® is a trademark owned by Chevron Intellectual Property LLC.

A sample of Group II base oil, 100R (such as Chevron Richmond Lube Oil Plant-manufactured (RLOP) 100R) was blended into fully formulated driveline fluids using three different viscosity modifiers (VM), and the traction coefficients were measured. When Group II base oil, 100R was blended into driveline fluids with different viscosity modifiers, significant differences in traction coefficients due to the different viscosity modifiers were measured. Differences were seen in the traction coefficients over the full range of slide to roll ratios, and the traction coefficients measured at a slide to roll ratio of 30% are summarized in Table 7.

TABLE 7

| Traction Coefficients at 30% SRR | | | | |
|---|---|---|---|---|
| Baseline Group II base oil, 100 R No VM | Liquid ethylene propylene copolymer | Synthetic polyolefin | Ester olefin copolymer | Polymethacrylate |
| 0.028 | 0.026 | 0.033 | 0.025 | 0.027 |

The liquid ethylene propylene copolymer was a liquid at room temperature. Additionally it met all of the following properties: an ethylene content from 45 to 60 mol %, a Mw/Mn of 1.0 to 2.3, and an intrinsic viscosity [η] from 0.2 to 1.0 dl/g. The liquid ethylene propylene copolymer was almost as effective as the ester olefin copolymer at reducing the traction coefficient of the lubricant blends using Group II base oil, 100R, such as Chevron RLOP 100R. The ester olefin copolymer was a dispersant-viscosity modifier, while the liquid ethylene propylene copolymer did not deliver dispersancy.

Similar trends for effects on the traction coefficient using different viscosity modifiers were also measured on fully formulated driveline fluids using Group II base oil, 220R (such as Chevron RLOP 220R), but the traction coefficients using Group II base oil, 220R were a bit higher. The slightly higher traction coefficients measured on the driveline fluids with Group II base oil, 220R were due to using reduced treat rates of the different viscosity modifiers.

Example 2: Effects on Traction Coefficient in Driveline Fluids Blended with API Group II Base Stocks Further blends were done to optimize the effect on traction coefficient using the liquid ethylene propylene copolymer, mixed into different formulated driveline fluids that comprised greater than 50 wt % API Group II base stock. All of the driveline fluids were blended with the same amount of an additive package designed to meet API Category GL-5. The results are summarized in Table 8 and are compared with a current commercial driveline fluid. As before, the traction coefficients were measured at a slide to roll ratio of 30%. The Group II base oil, 100R can be RLOP 100R.

TABLE 8

| Blend Description | Comparison Commercial Driveline Fluid with 100% Group IV Base Oil & Ester Olefin Copolymer | 100 wt % Group II base oil, 100 R & Liquid Ethylene Propylene Copolymer | 90 wt % Group II base oil, 100 R + 10 wt % PAO-4 & Liquid Ethylene Propylene Copolymer | 60 wt % Group II base oil, 100 R + 30 wt % 220 R + 10 wt % PAO-4 & Liquid Ethylene Propylene Copolymer |
|---|---|---|---|---|
| Base Oil Composition | 0 wt % API Group II Base Stock | 100 wt % API Group II Base Stock | 90 wt % API Group II Base Stock | 90 wt % API Group II Base Stock |
| Traction Coefficient | 0.0255 | 0.026 | 0.0225 | 0.023 |

All three of the driveline fluids with the liquid ethylene propylene copolymer added to a base oil having 90 wt % or greater API Group II base stock gave traction coefficients very similar to, or better, than the comparison commercial driveline fluid. The comparison commercial driveline fluid was a commercial Synthetic (PAO) 75W-90 gear oil, such as Chevron MULTIGEAR® S 75W-90.

This was unexpected, as it was believed previously that only driveline fluids blended with base oils comprising predominantly either API Group III or API Group IV base stocks could achieve these low levels of traction coefficient.

Example 3: Lubricant Mixtures with Group II Base Oil, 100R

A sample of a Group II base oil, 100R (such as Chevron RLOP 100R) was either used alone or blended with 10 wt % polyalphaolefin (PAO), PAO-4, to obtain base oil blends having a base oil blend kinematic viscosity at 100° C. of about 4.1 $mm^2/s$. The base oil blends were mixed with other driveline fluid components, including one of four different viscosity modifiers, a small amount of pour point depressant (PPD), and a commercial driveline fluid additive package supplied by Lubrizol to make lubricant mixtures suitable for use as driveline fluids. The pour point depressant used was a polymethacrylate, such as Lubrizol 7718. The compositions and properties of these lubricant mixtures are shown in Table 9 and Table 10.

TABLE 9

| VM Chemistry | Liquid ethylene propylene copolymer | Synthetic polyolefin | Ester olefin copolymer | Polymethacrylate |
|---|---|---|---|---|
| Base Oil Blend | | | | |
| 100 R | 90 | 90 | 100 | 100 |
| PAO-4 | 10 | 10 | 0 | 0 |
| Added Components, wt % | | | | |
| VM | 14.8 | 30.3 | 34.5 | 30 |
| PPD | 0.5 | 0.5 | 0.5 | 0.5 |
| Driveline Fluid Additive Pack | 10 | 10 | 10 | 10 |

TABLE 10

| VM Chemistry | Liquid ethylene propylene copolymer | Synthetic polyolefin | Ester olefin copolymer | Polymethacrylate |
|---|---|---|---|---|
| Viscosity @ 40° C., $mm^2/s$ | 75.84 | 84.12 | 73.67 | 73.82 |
| Viscosity @ 100° C., $mm^2/s$ | 12.36 | 12.54 | 12.68 | 12.37 |
| Viscosity Index | 161 | 146 | 173 | 167 |
| BV@−40° C., cP | 85,220 | 127,500 | 74,920 | 84,600 |
| KV100 After 20 Hour KRL | 11.8 | 11.8 | 12.3 | 11.6 |
| KRL Viscosity Loss, % | 4.3 | 6.7 | 3.2 | 5.9 |

BV@−40° C. refers to Low-Temperature Viscosity of Lubricants Measured by Brookfield Viscometer, also referred to as Brookfield Viscosity measured at −40° C. Brookfield Viscosity is measured by ASTM D2983-09.

All of these lubricant mixtures were suitable for use as driveline fluids and had a viscosity grade of 75W-85. However, only the lubricant mixture with the liquid ethylene propylene copolymer had a treat rate less than 20 wt %, and also had less than 5.5% viscosity loss in the 20 hour KRL shear stability test. The liquid ethylene propylene copolymer viscosity modifier had excellent thickening ability, such that much lower levels of viscosity modifier were needed. The amount of the liquid ethylene propylene copolymer that was used in this example was just 42.8% of the amount of synthetic polyolefin viscosity modifier, 48.8% of the amount of the ester olefin copolymer viscosity modifier, and 49.3% of the amount of the polymethacrylate viscosity modifier, to achieve a similar kinematic viscosity at 100° C. (between 12.36 and 12.68) of the driveline fluid.

Example 4: Lubricant Mixtures with Group II Base Oil, 220R

A sample of Group II base oil, 220R (such as Chevron 220R produced at the Richmond Lube Oil Plant (RLOP)) was either used alone or blended with 30 wt % Group II base oil, 100R (such as Chevron 100R) and 10 wt % polyalphaolefin (PAO), PAO-4, to obtain base oil blends having a base oil blend kinematic viscosity (BOV) at 100° C. of from 5.4 to 6.5 $mm^2/s$. The base oil blends were mixed with other driveline fluid components, including one of three different viscosity modifiers, a small amount of pour point depressant (PPD), and a driveline fluid additive package supplied by Lubrizol to make lubricant mixtures suitable for use as driveline fluids. The pour point depressant used was a polymethacrylate, such as Lubrizol 7718. The compositions and properties of these lubricants mixtures are shown in Table 11 and Table 12.

TABLE 11

| VM Chemistry | Liquid ethylene propylene copolymer | Ester olefin copolymer | Polymethacrylate |
|---|---|---|---|
| Base Oil Blend | 5.4 BOV | 6.5 BOV | 6.5 BOV |
| 220 R | 60 | 0 | 0 |
| 100 R | 30 | 100 | 100 |
| PAO-4 | 10 | 0 | 0 |
| | Components, wt % | | |
| VM | 11.8 | 24.5 | 21.0 |
| PPD | 0.5 | 0.5 | 0.5 |
| Driveline Fluid Additive Pack | 10 | 10 | 10 |

TABLE 12

| VM Chemistry | Liquid ethylene propylene copolymer | Ester olefin copolymer | Polymethacrylate |
|---|---|---|---|
| Viscosity @ 40° C., $mm^2/s$ | 81.9 | 82.05 | 83.75 |
| Viscosity @ 100° C., $mm^2/s$ | 12.43 | 12.53 | 12.51 |
| Viscosity Index | 149 | 151 | 147 |
| BV@−40° C., cP | 113,100 | 128,980 | 129,600 |
| KV100 After 20 Hour KRL | 12.02 | 12.08 | 11.95 |
| Viscosity Loss, % | 3.84 | 3.97 | 4.48 |

All of these lubricant mixtures were suitable for use as driveline fluids and had a viscosity grade of 75W-85. However, only the lubricant mixture with the ethylene propylene copolymer had a treat rate less than 20 wt %, and also had less than 5.5% viscosity loss in the 20 hour KRL shear stability test. The amount of the liquid ethylene propylene copolymer that was used in this example was 48.2% of the amount of the ester olefin copolymer viscosity modifier, and 56.1% of the amount of the polymethacrylate viscosity modifier, to achieve a similar kinematic viscosity at 100° C. (between 12.4 and 12.55) of the driveline fluid.

Example 5: Optimized Axle Oil Formulation

Fully formulated 75W-85 axle oils were blended as shown in Table 13. The Group II base oil, 100R can be RLOP 100R and Group II base oil, 220R can be RLOP 220R.

TABLE 13

| | Base Oil Blend | |
|---|---|---|
| | 60 wt % Group II base oil, 220 R/30 wt % Group II base oil, 100 R/10 wt % PAO-4 | 90 wt % Group II base oil, 100 R/10 wt % PAO-4 |
| Driveline Fluid Additive Package | 11 wt % | 11 wt % |
| Viscosity Modifier | 11.8 wt % liquid ethylene propylene copolymer | 14.1 wt % liquid ethylene propylene copolymer |
| Pour Point Depressant, Lubrizol 7718 | 0.5 wt % polymethacrylate | 0.5 wt % polymethacrylate |
| | Viscometrics and Shear Stability | |
| Viscosity @ 40° C., $mm^2/s$ | 80.8 | 71.9 |
| Viscosity @ 100° C., $mm^2/s$ | 12.34 | 11.84 |
| Viscosity Index | 150 | 161 |
| BV@−40° C., cP | 112,500 | 72,000 |
| KV100 After 20 Hour KRL | 11.92 | 11.42 |
| KRL Viscosity Loss, % | 3.40 | 3.55 |

The driveline fluid additive package was formulated by Lubrizol to provide excellent oxidation stability and enhanced dispersancy. The second of the above-referenced axle oil formulations (90 wt % Group II base oil, 100R/10 wt % PAO-4) was tested for traction coefficient and it had a very low traction coefficient at a slide to roll ratio of 30% of about 0.0226 at 120° C., lower than that obtained with commercial synthetic 75W-90 gear oil, such as Chevron MULTIGEAR® S 75W-90. Additionally this axle oil had a good film thickness in an EHD film thickness test.

This axle oil (second of the two listed formulations, 90 wt % Group II base oil, 100R/10 wt % PAO-4) was tested in a number of other performance tests as described in Table 14:

TABLE 14

| Test | Result | SAE J2360 Limit |
|---|---|---|
| ASTM D130 (121° C., 3 hrs) | 2A | 2A max |
| ASTM D892 | | |
| Seq I, ml | 0/0 | 20 max |
| Seq II, ml | 10/0 | 50 max |
| Seq III, ml | 0/0 | 20 max |
| ASTM D5662, Polyacrylate (150° C., 240 hrs) | | |
| Elongation Change, % | 0.8 | −60 min |
| Hardness Change, points | 3 | −35 to 5 |
| Volume Change, % | 1.3 | −5 to 30 |
| ASTM D5662, Fluoroelastomer (150° C., 240 hrs) | | |
| Elongation Change, % | −14.4 | −75 min |
| Hardness Change, points | −1 | −5 to 10 |
| Volume Change, % | 1.7 | −5 to 15 |

TABLE 14-continued

| Test | Result | SAE J2360 Limit |
|---|---|---|
| L-60-1, Thermal & Oxid. Stab. (ASTM D5704-15a) | | |
| Viscosity Increase, % | 5 | 100 max |
| Pentane Insolubles, wt % | 0.0 | 3 max |
| Toluene Insolubles, wt % | 0.0 | 2 max |
| Ave. Car./Var. (merits) | 10.0 | 7.5 min |
| Ave. Sludge (merits) | 9.6 | 9.4 min |
| L-42 High-speed Shock Axle Test (ASTM D7452) Standard, Coast Side Scoring Rating | | |
| Pinion | 9 | 23 max |
| Ring | 2 | 12 max |
| L-42 High-speed Shock Axle Test (ASTM D7452)Canadian, Coast Side Scoring Rating | | |
| Pinion | 6 | 23 max |
| Ring | 1 | 12 max |

The storage stability of this axle oil was also assessed over a period of 8 weeks at temperatures from −18° C. to 65° C., and the storage stability of the axle oil was good. This axle oil will meet all of the requirements of SAE J2360.

The transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed. Unless otherwise specified, all percentages are in weight percent.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art. Accordingly, the invention is to be construed as including all structure and methods that fall within the scope of the appended claims. Unless otherwise specified, the recitation of a genus of elements, materials or other components, from which an individual component or mixture of components can be selected, is intended to include all possible subgeneric combinations of the listed components and mixtures thereof.

The invention illustratively disclosed herein suitably may be practiced in the absence of any element which is not specifically disclosed herein.

What is claimed is:

1. A process for blending a driveline fluid, comprising:

a. selecting at least one API Group II base stock having a viscosity index from 90 to 119 and a pour point from −19° C. to 0° C. and an API Group IV base stock;

b. blending a base oil consisting of the API Group IV base stock and one or more of the API Group II base stock having a viscosity index from 90 to 119 and a pour point from −19° C. to 0° C., wherein the base oil contains less than 20 wt % of the API Group IV base stock; and c. adding to the blended base oil:

i. a viscosity modifier that is a liquid ethylene propylene copolymer having an ethylene content from 45 to 60 mol %, wherein the viscosity modifier reduces a traction coefficient of the driveline fluid; and ii. an additive package designed for the driveline fluid, to make the driveline fluid comprising 11-20 wt % of the viscosity modifier; wherein the driveline fluid has a driveline fluid viscosity index of 140 to 180 and has a percentage loss of kinematic viscosity at 100° C. in a 20 hour KRL shear stability test of less than 5.5%.

2. The process of claim 1, wherein the traction coefficient of the driveline fluid is from 0.019 to 0.028 when measured in a MTM traction measurement system at 120° C., with a 30% slide to roll ratio, and at a load of 72 Newton.

3. The process of claim 2, wherein the traction coefficient of the driveline fluid is 0.026 or less.

4. The process of claim 1, wherein the process provides the driveline fluid that is an SAE viscosity grade 75W-85.

5. The process of claim 1, wherein the at least one API Group II base stock has a first kinematic viscosity at 40° C. from 15 to 25 $mm^2/s$.

6. The process of claim 1, wherein the at least one API Group II base stock has the viscosity index from 90 to 109.

7. The process of claim 1, wherein the base oil contains two different API Group II base stocks.

8. The process of claim 7, wherein the two different API Group II base stocks are a first base stock having a first kinematic viscosity at 40° C. from 15 to 25 $mm^2/s$ and a second base stock having a higher kinematic viscosity at 40° C. from 40 to 46 $mm^2/s$.

9. The process of claim 1, wherein the adding of the viscosity modifier to the base oil increases the thermal and oxidative stability of the driveline fluid to give 5 to 50% viscosity increase in a L-60-1 test.

10. A driveline fluid composition, comprising:

a. a base oil consisting of at least one API Group II base stock having a viscosity index from 90 to 119 and a pour point from −19° C. to 0° C. and an API Group IV base stock, wherein the base oil contains less than 20 wt % of the API Group IV base stock;

b. 11-20 wt % of a viscosity modifier that is a liquid ethylene propylene copolymer having an ethylene content from 45 to 60 mol %, wherein the viscosity modifier reduces a traction coefficient of the driveline fluid; and c. an additive package designed for a driveline fluid;

wherein the driveline fluid composition has a driveline fluid viscosity index of 140 to 180 and has a percentage loss of kinematic viscosity at 100° C. in a 20 hour KRL shear stability test of less than 5.5%.

11. The driveline fluid composition of claim 10, wherein the driveline fluid composition has a traction coefficient of 0.019 to 0.028 when measured in a MTM traction measurement system at 120° C., with a 30% slide to roll ratio, and at a load of 72 Newton.

12. The driveline fluid composition of claim 11, wherein the traction coefficient is 0.026 or less.

13. The driveline fluid composition of claim 10, wherein the API Group II base stock has the viscosity index from 90 to 109.

14. The driveline fluid composition of claim 10, wherein the base oil contains two different API Group II base stocks.

15. The driveline fluid composition of claim 10, wherein the liquid ethylene propylene copolymer has a property selected from the group of: a Mw/Mn of 1.0 to 2.3, an intrinsic viscosity [η] from 0.2 to 1.0 dl/g, and combinations thereof.

16. The driveline fluid composition of claim 10, wherein the driveline fluid is an SAE viscosity grade 75W-85.

17. The driveline fluid composition of claim 10, wherein the additive package designed for the driveline fluid comprises performance additives selected from the group of antioxidants, dispersants, detergents, corrosion inhibitors, rust inhibitors, metal deactivators, antiwear agents, anti-seizure agents, wax modifiers, viscosity index improvers, seal compatibility agents, friction modifiers, lubricity agents, anti-staining agents, chromophoric agents, defoamants, demulsifiers, emulsifiers, densifiers, wetting agents, gelling agents, tackiness agents, colorants, and combinations thereof.

18. The driveline fluid composition of claim 10, wherein the base oil consists of a first API Group II base stock having a first kinematic viscosity at 40° C. from 15 to 25 $mm^2/s$, a second API Group II base stock having a higher kinematic viscosity at 40° C. from 40 to 46 $mm^2/s$, and less than 20 wt % of an API Group IV base stock having a PAO kinematic viscosity at 100° C. from 3 to 5 $mm^2/s$ and a PAO viscosity index from 115 to 130.

19. A method for lubricating a mechanical device, comprising: supplying to the mechanical device a driveline fluid composition, comprising:

a. a base oil consisting of an API Group IV base stock and at least one API Group II base stock having a viscosity index from 90 to 119 and a pour point from −19° C. to 0° C., wherein the base oil contains less than 20 wt % of the API Group IV base stock;

b. 11-20 wt % of a viscosity modifier that is a liquid ethylene propylene copolymer having an ethylene content from 45 to 60 mol %, wherein the viscosity modifier reduces a traction coefficient of the driveline fluid; and c. an additive package designed for a driveline fluid;

wherein the driveline fluid composition has: a driveline fluid viscosity index of 140 to 180 and a percentage loss of kinematic viscosity at 100° C. in a 20 hour KRL shear stability test of less than 5.5%; and wherein the mechanical device is an axle or a manual transmission.

20. The driveline fluid composition of claim 10, wherein the driveline fluid composition meets SAE J306.

21. The driveline fluid composition of claim 10, comprising:

a. a base oil consisting of 90 wt % of the API Group II base stock and 10 wt % of the API Group IV base stock;

b. 14.8 wt % of the viscosity modifier that is a liquid ethylene propylene copolymer having an ethylene content from 45 to 60 mol %; and c. 10.5 wt % of the additive package designed for a driveline fluid.

22. The process of claim 1, comprising blending a base oil consisting of 90 wt % of the at least one API Group II base stock and 10 wt % of the API Group IV base stock, and wherein the driveline fluid comprises 14.8 wt % of the viscosity modifier and 10.5 wt % of the additive package.

23. The method of claim 19, wherein the driveline fluid composition comprises a. a base oil consisting of 90 wt % of the API Group II base stock and 10 wt % of the API Group IV base stock;

b. 14.8 wt % of the viscosity modifier that is a liquid ethylene propylene copolymer having an ethylene content from 45 to 60 mol %; and c. 10.5 wt % of the additive package designed for a driveline fluid.

* * * * *